US009683526B2

(12) United States Patent
Matsuura et al.

(10) Patent No.: US 9,683,526 B2
(45) Date of Patent: Jun. 20, 2017

(54) CANISTER

(71) Applicant: ROKI CO., LTD., Hamamatsu-shi, Shizuoka (JP)

(72) Inventors: Kazuya Matsuura, Hamamatsu (JP); Takahiro Tashiro, Hamamatsu (JP)

(73) Assignee: ROKI CO., LTD., Hamamatsu-shi (JP)

( * ) Notice: Subject to any disclaimer, the term of this patent is extended or adjusted under 35 U.S.C. 154(b) by 253 days.

(21) Appl. No.: 14/603,727

(22) Filed: Jan. 23, 2015

(65) Prior Publication Data

US 2015/0240757 A1 Aug. 27, 2015

(30) Foreign Application Priority Data

Feb. 26, 2014 (JP) ..... 2014-034846

(51) Int. Cl.
*F02M 33/02* (2006.01)
*F02M 25/08* (2006.01)

(52) U.S. Cl.
CPC ..... *F02M 25/0854* (2013.01)

(58) Field of Classification Search
CPC ..... F02M 25/0872; F02M 2025/0863; F02M 25/0854; F02M 25/0836
USPC ..... 123/516–520, 198 D; 96/135, 139, 141, 96/144
See application file for complete search history.

(56) References Cited

U.S. PATENT DOCUMENTS 4,598,686 A * 7/1986 Lupoli ..... F02M 25/0854 123/519
4,721,846 A * 1/1988 Lupoli ..... F02M 25/0854 123/549
4,877,001 A * 10/1989 Kenealy ..... F02M 25/0854 123/519
4,951,643 A * 8/1990 Sato ..... F02M 25/0836 123/519
2004/0007135 A1* 1/2004 Ikuma ..... F02M 25/0854 96/135
2005/0229787 A1* 10/2005 Meiller ..... B01D 53/0415 96/152
2007/0227361 A1* 10/2007 Kasuya ..... B01D 53/0415 96/135
2008/0302245 A1* 12/2008 Yoshida ..... B01D 53/0415 96/146

(Continued)

FOREIGN PATENT DOCUMENTS

JP 2003-3915 A 1/2003

*Primary Examiner* — John Kwon
(74) *Attorney, Agent, or Firm* — Sughrue Mion, PLLC

(57) ABSTRACT

A canister includes: a casing provided with a cylindrical case member having one end closed as a bottom portion and another end opened as an opened portion, and a cylindrical bottom case member closing the opened portion of the cylindrical case member, the casing being formed with a fuel vapor introducing port, a purge port and an air communication port; an adsorbent material disposed within the cylindrical case member; a pad member disposed between the adsorbent material and the cylindrical bottom case member; a grid member disposed between the adsorbent material and the cylindrical bottom case member, the pad member and the grid member being laminated as a lamination layer; and an air ventilation path formed to the grid member so as to extend in axial and radial directions of the casing in a meandering manner.

6 Claims, 5 Drawing Sheets

(56) References Cited

U.S. PATENT DOCUMENTS

| | | | | |
|---|---|---|---|---|
| 2009/0013973 | A1* | 1/2009 | Yamasaki | F02M 25/0854 123/519 |
| 2009/0320806 | A1* | 12/2009 | Lang | B01D 53/0407 123/519 |
| 2012/0024158 | A1* | 2/2012 | Makino | B01D 53/0438 96/154 |
| 2014/0165843 | A1* | 6/2014 | Omichi | B01D 53/0446 96/144 |
| 2015/0316008 | A1* | 11/2015 | Catton | F02M 25/0854 96/152 |

* cited by examiner

CANISTER

BACKGROUND OF THE INVENTION

Field of the Invention

The present invention relates to a canister for treating a fuel evaporated from a fuel supply source equipped for a vehicle such as an automobile.

Related Art

Generally, a canister of the kind mentioned above has a structure provided with a case member to which a fuel vapor introducing port, a purge port and an air (atmosphere) communication port and in which an adsorbent material (adsorption agent or adsorbent) is enclosed, a pad supporting the adsorbent material and a grid member pressing the adsorbent material and the pad in an axial direction thereof, and a filter element in form of sheet made of felt or like is disposed at an end portion of the grid member.

With the canister of the structure mentioned above, in a structure in which the fuel vapor introducing port is connected to a fuel tank and the purge port is connected to an internal combustion engine, if the internal combustion engine is stopped, the fuel vapor evaporated from the fuel tank is introduced into the canister through the fuel vapor introducing port to thereby adsorb and hold the fuel vapor by an adsorbent material so as to prevent the fuel vapor from being released externally into atmosphere. On the other hand, during a time when the internal combustion engine is operated, the fuel vapor adsorbed by the adsorbent material under a negative pressure is fed on the internal combustion engine side.

Further, during the operation of the internal combustion engine, although the air (atmospheric air) is introduced through the air communication port and the fuel vapor held by the adsorbent material is fed out on the internal combustion engine side, it becomes necessary to appropriately filtrate dust and/or dirt contained in the air. Because of such reason, there have been proposed some known structures for filtrating such air, and in one known example, a filter element made of felt or like material is disposed at an end portion of the location of the adsorbent material.

There has been also known a conventional structure in which an air passage is formed to a case member so that the air introduced through the air communication port, as disclosed in Patent Document 1 (Japanese Patent Laid-open No. 2003-3915).

A canister disclosed in the Patent Document 1 is configured such that an air passage is provided in the vicinity of an air communication port to remove dust and dirt contained in the air (atmospheric air), and hence, such arrangement contributes to prevent the filter element from being clogged.

However, in the canister disclosed in the Patent Document 1, the air passage is formed inside the case member, and hence, the structure of the canister is made complicated, and in addition, since the above structure includes members such as filter element and grid member which are arranged in the conventional structure, the number of members or parts increases. Thus, manufacturing cost also increases, being inconvenient and disadvantageous.

SUMMARY OF THE INVENTION

The present invention was made in consideration of the circumstances mentioned above, and an object thereof is to provide a canister capable of being manufactured with reduced cost while maintaining dust/dirt removing performance achieved by a conventional structure or arrangement.

The above and other objects can be achieved according to the present invention by providing a canister which includes: a casing provided with a cylindrical case member having one end closed as bottom portion and another end opened as an opened portion, and a cylindrical bottom case member closing the opened portion of the cylindrical case member, the casing being formed with a fuel vapor introducing port, a purge port and an air communication port; an adsorbent material disposed within the cylindrical case member; a pad member disposed between the adsorbent material and the cylindrical bottom case member; a grid member disposed between the adsorbent material and the cylindrical bottom case member, the pad member and the grid member being laminated as a lamination layer; and an air ventilation path formed to the grid member so as to extend in axial and radial directions of the casing in a meandering manner.

The present invention may have the following preferred embodiments.

It may be desired that the air communication port is formed to the cylindrical bottom case member and the fuel vapor introduction port and the purge port are formed to the bottom portion of the cylindrical case member.

It may be desired that the grid member is provided with a bottom surface portion abutting against the pad member and a side surface portion extending from a peripheral edge portion of the bottom surface portion along an inner wall portion of the case member, and the bottom surface portion is formed with a plurality of first openings and second openings so as to extend along a circumferential direction thereof and also formed with an intermediate wall portion so as to extend in parallel with the side surface portion thereof, in which the intermediate wall portion has a length shorter than that of the side surface portion in an axial direction of the grid member.

It may be further desired that the first openings and the second openings communicate with each other through introduction ports provided between the bottom surface portion and the intermediate wall portion.

It may be also desired that the air communication port is formed so as to face a central portion of the bottom surface portion.

It may be further desired that the central portion of the bottom surface portion is formed with a through hole extending in the axial direction of the grid member.

A further pad member may be disposed between the adsorbent material and the bottom portion of the case member.

The above-mentioned preferred embodiments are not all the features essential for the present invention and sub-combinations thereof will also constitute the present invention.

According to the present invention of the characters mentioned above, the grid member is formed with the air ventilation path extending in the axial and radial directions of the grid member in the meandering manner. Therefore, dust and dirt contained in the air can be removed within the air ventilation path, which results in elimination of location of a filter member, thus reducing the number of parts, and hence, being economical in cost.

The nature and further characteristic features and functions of the present invention will be made clearer from the following descriptions with reference to the accompanying drawings.

DESCRIPTION OF THE PREFERRED EMBODIMENT

A preferred embodiment for carrying out the present invention will be described hereunder with reference to the accompanying drawings. It is to be noted that the described embodiment is not limited to the present invention recited in appended claims and combinations of characteristics of the embodiment described in the present specification is not essential to solve the problems and/or to achieve the object of the present invention, and it is also to be noted that terms such as "upper", "lower", "right", "left" and others indicating direction or like are used herein with reference to the illustration of the drawings.

Figure 1:
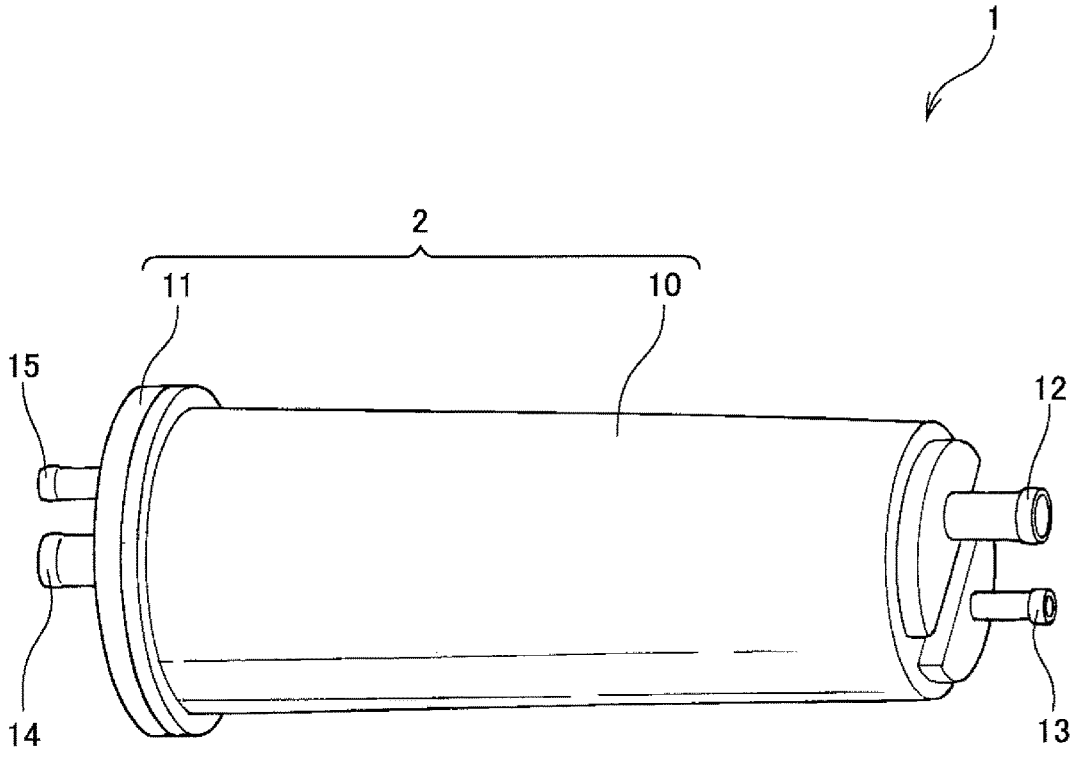
FIG. 1 is a perspective view illustrating a canister according to one embodiment of the present invention.

With reference to FIG. 1, a canister 1 of the present embodiment is provided with a casing 2 composed of a case member 10 and a bottom case member 11.

The case member 2 is provided with a purge port 12 connected to an air intake passage of an internal combustion engine and configured to deliver fuel vapor captured inside the canister 1 to the air intake passage and a fuel vapor introducing port 13 connected to a fuel tank and configured to introduce the fuel vapor inside the canister 1. The bottom case member 11 is provided with an air, such as atmospheric air, communication port 14 through which air is introduced into or fed out from the inside of the canister and a water drain port 15 for discharging water flown into the canister through the air communication port 14 outside the canister 1.

Figure 2:
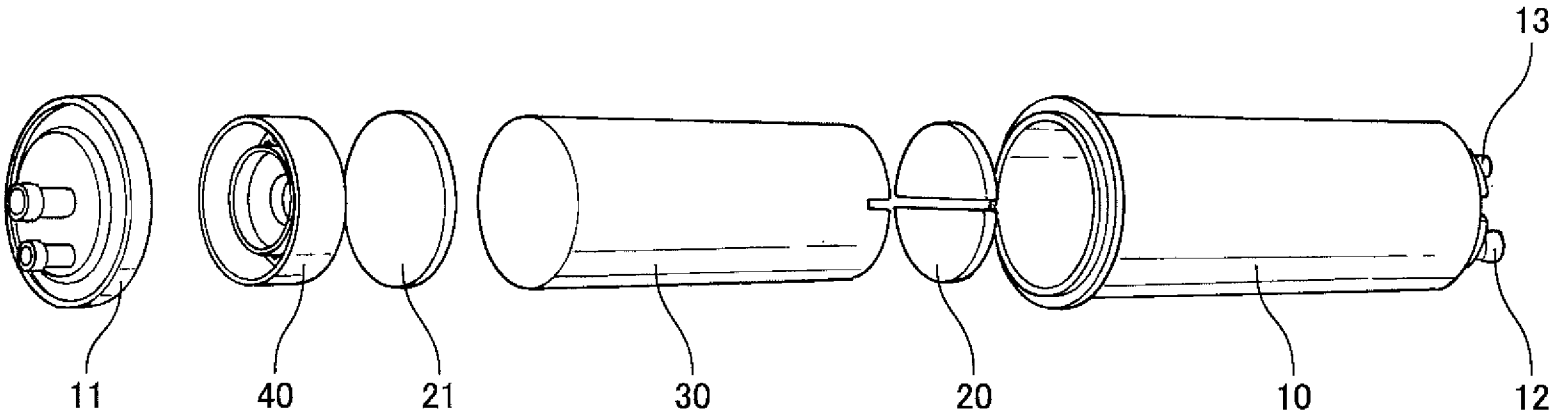
FIG. 2 is a developed perspective view of the canister illustrated in FIG. 1.

As shown in FIG. 2, the case member 10 has a cylindrical bottomed structure having one end closed and another end opened, and the bottom case member 11 has cylindrical, i.e., substantially disc-shaped, structure. The bottom case member 11 is integrally assembled with the case member 10 by means of vibration welding so as close an opened end of the case member 10. The case member 10 and the bottom case member 11 are both formed of synthetic resin material, and more specifically, these case members 10 and 11 are formed preferably of thermoplastic synthetic resin such as polypropylene series resin, polyamide resin and the like.

An adsorbent material (adsorbent) 30 is housed in the case member 10, and first and second pads 20 and 21 are disposed to axial both ends of the adsorbent material 30, respectively. The adsorbent material 30 is preferably formed of a particular active carbon, and as the first and second pads 20 and 21, sheet members having elasticity and good ventilation performance are used.

The second pad 21 disposed on the side of the bottom case member 11 of the adsorbent material 30, and the grid member 40 is disposed thereon in the laminated manner. In such structure, when the grid member 40 is pressurized by welding the bottom case member 11 to the grid member 40, the second pad 21 pushes the adsorbent material 40 against such pressure application as repulsive force, thereby appropriately packing the adsorbent material 40.

Incidentally, the first pad 20 has a divided structure so as to accord with the locations of the purge port 12 and the fuel vapor introduction port 13, respectively. It is however to be noted that the first pad 20 may be composed as a single plate-like structure without being divided into two parts.

Figure 3:
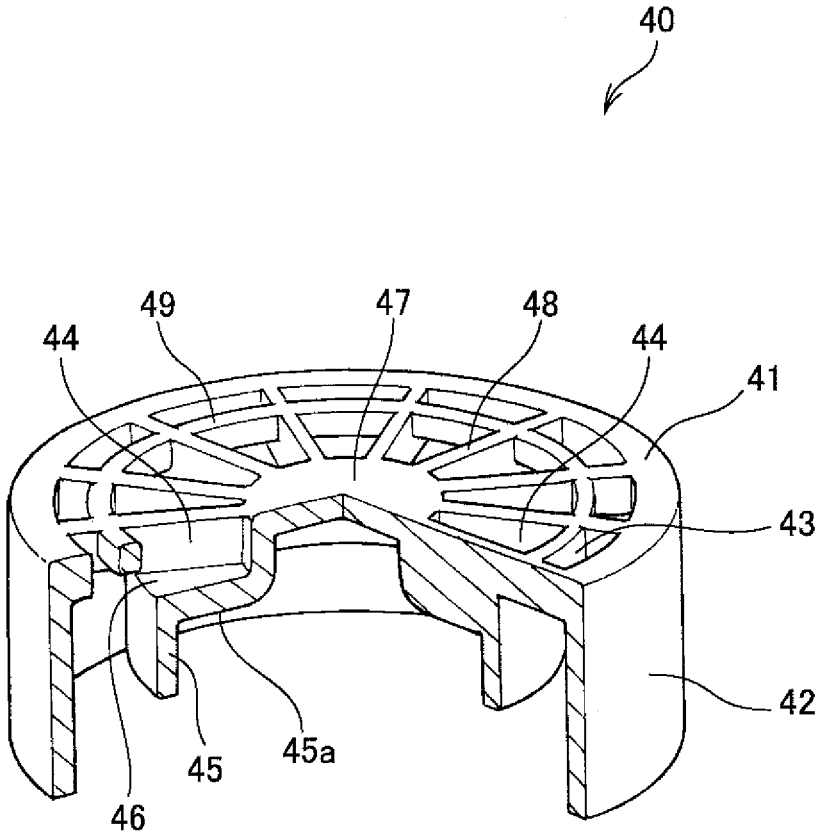
FIG. 3 is a sectional view, partially cut away, of a grid member of the canister according to the present embodiment.

As shown in FIG. 3, the grid member 40 is provided with a bottom surface portion 41 abutting against the second pad 21 and a cylindrical side surface portion 42 extending along an inner wall portion of the case member 10 from the peripheral edge of the bottom surface portion 41. The bottom surface portion 41 is formed with a plurality of first openings 43 and second openings 44 both arranged in the circumferential direction of the bottom surface portion 41. These first and second openings 43 and 44 are sectioned by a plurality of radial ribs 48 and concentric ribs 49, in which the radial ribs 48 are arranged so as to extend in the radial direction from a flat central portion 47 of the bottom surface portion 41.

Furthermore, a cylindrical intermediate wall portion is formed on a surface portion of the bottom surface portion 41 opposing to the surface abutting against the second pad 21 so as to extend in parallel with the side wall portion 42. The intermediate wall portion 45 has an axial length shorter than the length of the side wall portion 42 so as to be continuous to a continuous portion 45*a* extending from the central portion 47. Moreover, a plurality of introduction ports 46 are formed to crossing positions of the intermediate wall portion 45 and the bottom surface portion 41 along the circumferential direction of the intermediate wall portion 45. The introduction port 46 is communicated with the first openings 43 and the second openings 44 to each other.

Figure 4:
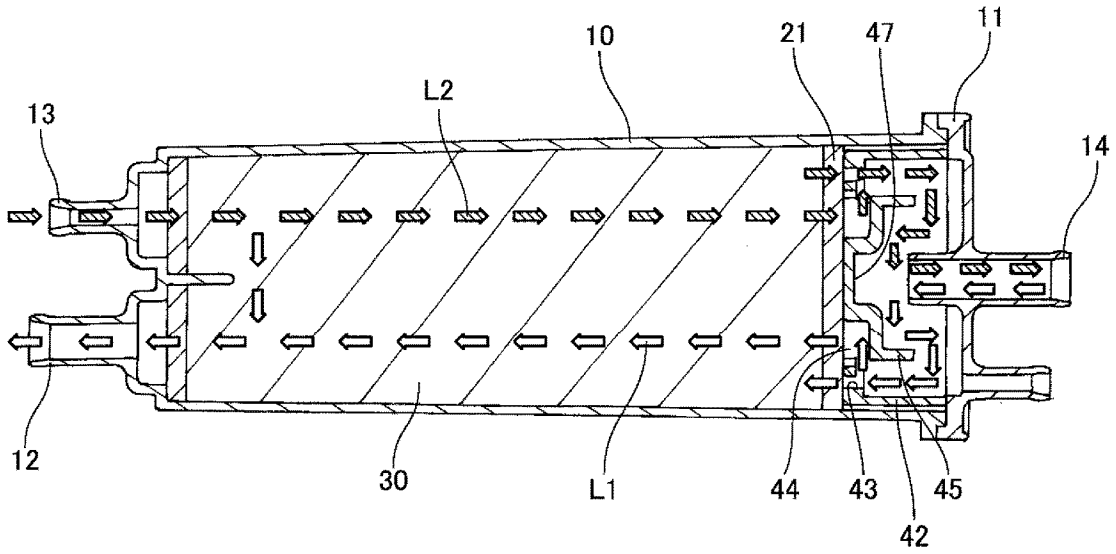
FIG. 4 is a longitudinal sectional view showing a ventilation direction within the canister illustrated in FIG. 1.

As shown in FIG. 4, the air communication port 14 is formed to a position opposing to the central portion 47 of the grid member 40, and air ventilation path is formed in a meandering manner in the axial and radial directions of the casing 2 by the bottom case member 11 and the grid member 40.

When an internal combustion engine is operated, in the air ventilation pathway shown with letter L1, air is introduced into the canister 1 through the air introduction port 14 because of negative pressure inside the intake manifold of the internal combustion engine. The air introduced into the canister 1 collides with the central portion 47 and then spreads in the radial direction. The air spread in the radial direction is guided on the side of the bottom case member 11 along the intermediate wall portion 45, and after the collision with the bottom case member 11, the air is further guided in the radial direction. The air is then guided in the axial direction along the side surface portion 42 of the grid member 40 and fed out on the internal combustion engine side, together with the fuel vapor adsorbed and held by the adsorbent material, through the first and second openings 43 and 44.

As described above, during the operation of the internal combustion engine, since the air passes in the air ventilation path between the bottom case member 11 and the grid member 40 in the meandering manner in the axial and radial directions, dust and dirt contained in the air can be shaken every time when the air turns in the path. Accordingly, the clogging of the second pad 21 can be prevented in an early stage of the operation. Further, in a case when the first openings 43 clog, the second openings 44 constitute a bypass from the introduction port 46 for enabling the air to be introduced.

On the contrary, during the operation stop time of the internal combustion engine, as shown in an air ventilation pathway L2, the fuel vapor generated in the fuel tank is prevented from being discharged into atmosphere by introducing the fuel vapor into the canister from the fuel vapor introduction port 13 and adsorbing and holding the fuel vapor with the adsorbent material.

The canister 1 of the structure mentioned above can perform removal of dust and dirt contained in the air by constituting the air pathway with the grid member 40 and the bottom case member 11 without being provided with any filter element which is provided in a conventional structure, and accordingly, the number of constitutional parts or elements can be reduce. In addition, since the air ventilation path can be formed by vibration welding while pushing the grid member 40 by the bottom case member 11, which is a method that could be done by a conventional method, the canister can be manufactured at low cost with performance of the canister being maintained as well.

Figure 5:
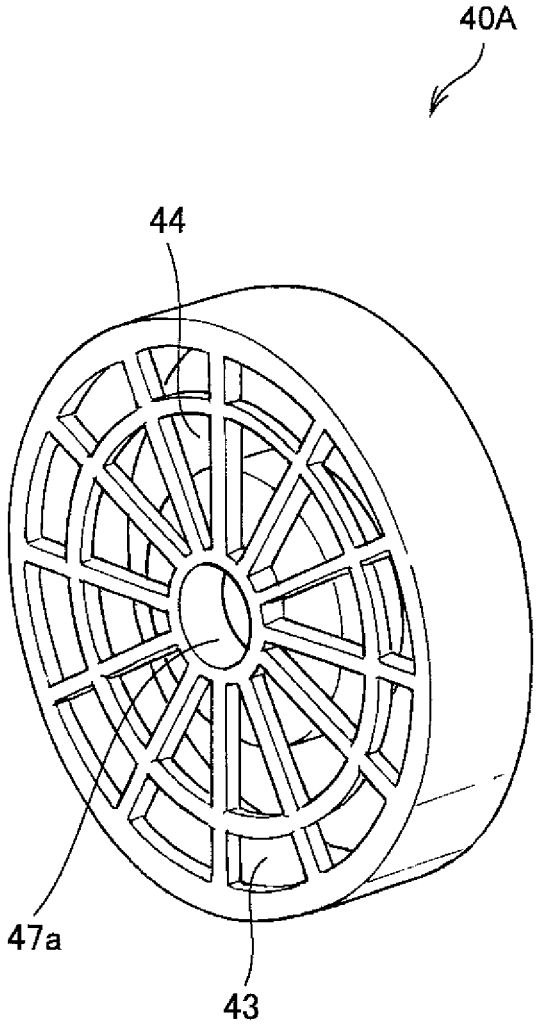
FIG. 5 is a view illustrating a modified example of the grid member according to the present embodiment.

It is to be noted that although the grid member according to the described embodiment was explained hereinabove with reference to the case in which the central portion 47 is formed to be flat, a grid member 40A as shown in FIG. 5, may be formed with a through hole 47*a* to the central portion 47 thereof. In such structure, air introduced through the atmospheric are introducing port 14 at the internal combustion engine operating time collides with the second pad 21 through the through hole 47*a* to thereby shake off dust and dirt. Thereafter, if clogging is caused to a portion of the second pad 21 facing the through hole 47*a*, the air can be introduced into the canister 1 through the ventilation pathway L1 as shown in and explained with reference to FIG. 4.

According to the structure mentioned above, since the portion facing the central portion 47 of the second pad 21 can be effectively utilized, the usable life time of the canister can be elongated, thus being economical and advantageous.

In the forgoing description of the canister of the present invention, the fuel vapor introduction port 13 and the purge port 12 are formed to the case member (cylindrical bottomed case member) 10, and the air communication port 14 is formed to the bottom case member 11, that is, the fuel vapor introduction port 13 and the purge port 12 are formed to one end of the cylindrical casing 2 and the air communication port 14 is formed to the other end of the cylindrical casing 2. However, in a preferred modification, the fuel vapor introduction port 13, the purge port 12 and the air communication port 14 are formed to one end portion of the casing 2, and the adsorbent material 30 may be disposed in a separated manner so as to accord with the locations of the fuel vapor introduction port 13, the purge port 12 and the air communication port 14 within the casing by disposing a partition wall member for sectioning the inside of the air ventilation path.

Moreover, in the canister according to the present invention, although the case member 10 and the bottom case member 11 are welded by means of vibration welding, the welding method is not limited to the vibration welding, and an ultrasonic welding, for example, may be utilized. This and other alternations or modifications may be within technical scope of the present invention defined by the appended claims.

What is claimed is:

1. A canister comprising:

a casing provided with a cylindrical case member having one end closed as a bottom portion and another end opened as an opened portion, and a cylindrical bottom case member closing the opened portion of the cylindrical case member, the casing being formed with a fuel vapor introducing port, a purge port and an air communication port;

an adsorbent material disposed within the cylindrical case member;

a pad member disposed between the adsorbent material and the cylindrical bottom case member;

a grid member disposed between the adsorbent material and the cylindrical bottom case member, the pad member and the grid member being laminated as a lamination layer; and an air ventilation path formed to the grid member so as to extend in axial and radial directions of the casing in a meandering manner, wherein the grid member includes:

a bottom surface portion abutting against the pad member; and a side surface portion extending from a peripheral edge portion of the bottom surface portion along an inner wall portion of the case member, and wherein the bottom surface portion is formed with a plurality of first openings and a plurality of second openings so as to extend along a circumferential direction thereof and also formed with an intermediate wall portion so as to extend in parallel with the side surface portion thereof, in which the intermediate wall portion has a length shorter than that of the side surface portion in an axial direction of the grid member.

2. The canister according to claim 1, wherein the air communication port is formed to the cylindrical bottom case member and the fuel vapor introduction port and the purge port are formed to the bottom portion of the cylindrical case member.

3. The canister according to claim 1, wherein the first openings and the second openings communicate with each other through introduction ports provided between the bottom surface portion and the intermediate wall portion.

4. The canister according to claim 1, wherein the air communication port is formed so as to face a central portion of the bottom surface portion.

5. The canister according to claim 4, wherein the central portion of the bottom surface portion is formed with a through hole extending in the axial direction of the grid member.

6. The canister according to claim 1, further comprising a further pad member disposed between the adsorbent material and the bottom portion of the case member.

* * * * *